United States Patent [19]

Haidle et al.

[11] Patent Number: 5,030,329

[45] Date of Patent: Jul. 9, 1991

[54] METHOD OF FORMING A HELICAL WAVEGUIDE USING A DEPOSIT SCREEN

[75] Inventors: Rudy H. Haidle; Robert I. Altkorn, both of Evanston; Michel E. Marhic, Avanston, all of Ill.

[73] Assignee: L'Air Liquide, Societe Anonyme Pour L'Etude Et L'Exploitation Des Procedes Georges Claude, Paris, France

[21] Appl. No.: 324,743

[22] Filed: Mar. 17, 1989

[51] Int. Cl.[5] ..... C25D 1/02

[52] U.S. Cl. ..... 204/9

[58] Field of Search ..... 204/9

[56] References Cited

U.S. PATENT DOCUMENTS 4,194,808 3/1980 Marhic et al. ..... 350/96.32

FOREIGN PATENT DOCUMENTS 46-06146 2/1971 Japan .

*Primary Examiner*—T. M. Tufariello

*Attorney, Agent, or Firm*—Oblon, Spivak, McClelland, Maier & Neustadt

[57] ABSTRACT

A method for forming a helical waveguide uses a deposit screen such as tape to prevent the deposit of unwanted material between the turns of the helix. The waveguide is formed by electroplating of nickel on a mandrel. The mandrel has raised portions similar to a screw on which the waveguide is formed. The deposit screen is placed in the recessed areas between the raised areas on the mandrel to prevent the mandrel from being plated in these areas. This prevents the turns of the helix from touching each other. The resultant helix is easily removed without damage to the waveguide or mandrel.

16 Claims, 1 Drawing Sheet

METHOD OF FORMING A HELICAL WAVEGUIDE USING A DEPOSIT SCREEN

BACKGROUND OF THE INVENTION

1. Field of the Invention

The present invention relates to a method for forming a helical waveguide and more particularly to a method for forming an electroplated helical waveguide on a mandrel.

2. Discussion of the Background

Although fiber optic waveguides have been employed for visible light, they are not effective for transmitting infrared light. This is due to the large losses which occur when using infrared radiation. Attempts have been made to produce waveguides for infrared radiation which will allow this radiation to be maneuvered into remote locations without requiring bulky rotating mirrors and articulated arms.

One device for transmitting infrared radiation is shown in U.S. Pat. No. 4,194,808. This device utilizes a polished copper surface, as shown in FIG. 2 of the patent for carrying the surface waves of infrared radiation. This device has been successful in practice, but is difficult to manufacture due to the particular shape involved.

SUMMARY OF THE INVENTION

Accordingly, one object of this invention is to provide a method for easily manufacturing helical waveguides.

A second object of this invention is to provide a method for forming helical waveguides which produces no damage to the mandrel used.

A third object of this invention is to provide a method for inexpensively producing helical waveguides of high quality.

Another object of this invention is to provide a novel method of producing a helical waveguide by placing deposit screens on the mandrel.

Briefly, these and other objects of the invention are achieved by placing a deposit screen on the mandrel in a helical form to prevent the turns of the helix from touching each other when formed.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
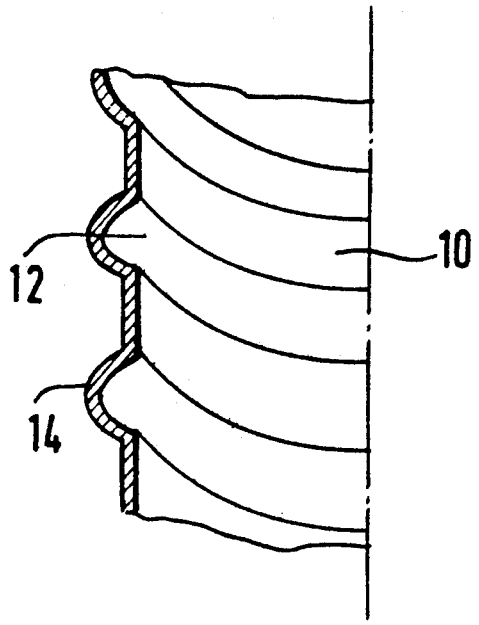
FIG. 1 shows the formation of a waveguide without the deposit screen.

Various other objects, features and attendant advantages of the present invention will be more fully appreciated as the same becomes better understood from the following detailed description when considered in connection with the accompanying drawings in which like reference characters designate like or corresponding parts throughout the several views and wherein FIG. 1 shows a mandrel 10 upon which the waveguide is formed. The mandrel preferably has the shape of a cylinder having raised portions 12 extending around the surface of the cylinder in a helix.

In order to form the waveguide, the mandrel is subjected to an electroplating operation using preferably nickel as the metal to be plated. It is also possible to use copper or a combination, such as copper and nickel. If the mandrel is electroplated without any further procedures, a solid coat of nickel 14 is formed completely over the mandrel. Since the waveguide is designed to be in a helix, it would then be necessary to remove part of the nickel from between the helical turns. This is a difficult operation and may cause damage to the mandrel or the waveguide. It is preferable not to damage the mandrel since it may be reused many times. Although it is also possible to unscrew the mandrel from the plating, this is difficult and also presents the possibility of damaging the mandrel by the friction between the mandrel and the plating.

Figure 2:
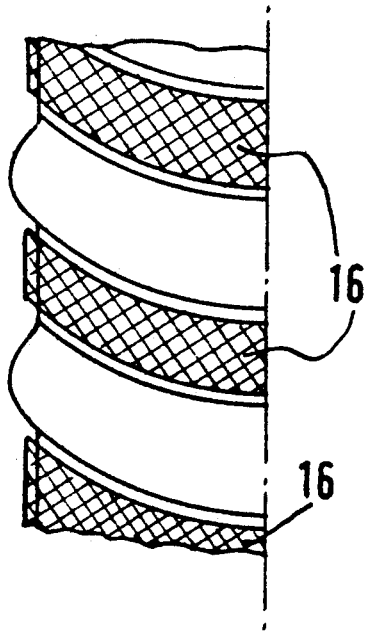
FIG. 2 shows the formation of a waveguide according to the present invention using the deposit screen.

The present invention improves on the situation by the method shown in FIG. 2. As is well known in the electroplating art, it is possible to provide deposit screens to cover any part which is not to be subject to the plating operation. In the present invention, such a deposit screen, such as a plastic tape 16, may be placed over the areas which are not to be electroplated. Specifically, if the areas on the surface of the mandrel which are not raised are covered by this tape, the remaining raised areas will form a single helix with the turns of the helix being separated from each other. With this situation, the helix may be easily removed from the mandrel and require no further processing before it may be used as a waveguide. Since the plating follows the surface of the raised portions, the waveguide will have a concave cross sectional shape which is desired for effective light transmission. Since the waveguide is easily removed from the mandrel by peeling, no further processing is necessary on the mandrel and accordingly the mandrel is not subjected to any procedures which may cause damage thereto.

As mentioned before, the raised portions of the mandrel form a helix on the surface of the mandrel. Accordingly, the areas which are not raised also form a helix. In protecting these areas with a non-conductive tape, it is then possible to merely start at one end of the mandrel and wrap the tape around the mandrel on a similar helix to completely cover the desired area without the need for covering joints. The tape should be approximately the width of the area to be covered or about ⅛ of an inch wide. A series of layers may be provided if necessary or desired. Different width tapes could be used for different size waveguides.

As is known, the presence of the tape prevents the passage of electrical current therethrough, thus preventing plating from occurring at those locations. At the end of the plating process, the tape may be removed by merely peeling it off. Alternatively, it is possible to leave the tape in place until the guide has been moved and then remove the tape in a similar fashion.

Although the present invention has been described as using electroplating, it is clear that the waveguides would be fabricated by any type of metal deposition procedure, such as vapor deposition, sputtering or other types of deposition. Also, although the use of plastic tape was described, any kind of deposit screen which prevents the flow of electricity could be used, including such things as paint, rubber strips or cloth tape or other types of non-conductive material. It would also be possible to form a slightly different shaped waveguide on the mandrel if desired. Thus, if a long helix was not desired it would be possible to form a series of one-turn waveguides by placing bands of the deposit screen at intervals along the axis of the mandrel.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A method for forming a waveguide comprising the steps of:

providing a mandrel having an outer cylindrical surface with part of the outer surface being raised to form a substantially helical raised portion;

covering the part of the outer cylindrical surface which is not raised with a deposit screen;

and depositing metal by electroplating on said substantially helical raised portion of said outer cylindrical surface to form a waveguide.

2. The method according to claim 1, wherein said metal is nickel.

3. The method according to claim 1, wherein said metal is copper.

4. The method according to claim 1, wherein said metal is a combination of nickel and copper.

5. The method according to claim 1, wherein the deposit screen is non-conductive tape.

6. The method according to claim 5, wherein the non-conductive tape is plastic tape.

7. The method according to claim 1, wherein the waveguide formed is a whispering gallery waveguide formed in a helix.

8. A method for forming a waveguide comprising the steps of:

providing a mandrel having an outer surface with part of the outer surface being raised to form a substantially convex raised portion;

covering the part of the outer surface which is not raised with a deposit screen;

depositing metal on said substantially convex raised portion of said outer surface to form a predetermined pattern of deposited metal on the mandrel; and forming a waveguide for conducting radiant energy by removing the predetermined pattern of the deposited metal from the outer surface of the mandrel.

9. A method according to claim 8, wherein said outer surface is cylindrical and said raised portion forms a helix.

10. A method according to claim 8, wherein said step of depositing is electroplating.

11. A method according to claim 10, wherein said metal is nickel.

12. A method according to claim 10, wherein said metal is copper.

13. A method according to claim 10, wherein said metal is a combination of nickel and copper.

14. A method according to claim 8, wherein said deposit screen is non-conductive tape.

15. A method according to claim 14, wherein said non-conductive tape is plastic tape.

16. A method according to claim 8, wherein said waveguide is a whispering gallery waveguide formed in a helix.

* * * * *